United States Patent [19]

Jackson

[11] Patent Number: 4,558,807

[45] Date of Patent: Dec. 17, 1985

[54] UMBRELLA HOLDER

[76] Inventor: André J. Jackson, 3978 Woodhue Pl., Alexandria, Va. 22309

[21] Appl. No.: 592,015

[22] Filed: Mar. 21, 1984

[51] Int. Cl.[4] ..... A45B 25/24

[52] U.S. Cl. ..... 224/251; 224/258; 224/915

[58] Field of Search ..... 224/258, 235, 251, 915, 224/257, 202, 916

[56] References Cited

U.S. PATENT DOCUMENTS

| | | | |
|---|---|---|---|
| 1,903,798 | 4/1933 | Turner | 224/235 |
| 2,448,404 | 8/1948 | Ackerman | 224/915 |
| 3,279,663 | 10/1966 | Torres | 224/251 |

FOREIGN PATENT DOCUMENTS

| | | | |
|---|---|---|---|
| 2644060 | 4/1978 | Fed. Rep. of Germany | 224/915 |
| 23283 | of 1895 | United Kingdom | 224/915 |

OTHER PUBLICATIONS

"Weather Beater", Science Illustrated, Apr. 1947.

*Primary Examiner*—Stephen Marcus
*Assistant Examiner*—David Voorhees
*Attorney, Agent, or Firm*—Millen & White

[57] ABSTRACT

This invention is a carrier for an umbrella which includes a tubular sheath supported from the shoulder of the user by a strap.

7 Claims, 5 Drawing Figures

UMBRELLA HOLDER

BACKGROUND OF THE INVENTION

This invention relates to umbrella holders. More specifically, this invention relates to a holder for carrying a closed umbrella wherein the umbrella has a telescoping stem and wherein the umbrella holder can be suspended from one shoulder or across the body.

Umbrellas are universally used devices which have been in use for centuries. Modern umbrellas not only fold to a relatively compact form, but have telescoping handles. They are frequently carried out only when it rains, but when there is the possibility of rain. When it is not in use, and is being carried by the user, an umbrella must be carried by hand and is likely to be lost or stolen. Moreover, if the user is carrying other items, carrying an umbrella can become rather inconvenient. In addition, if the person has been out in the rain with an umbrella, and the rain ceases or the person comes inside, the person is still confronted with a wet umbrella which will wet anything that it touches.

Various attempts have been made to devise a holder to carry an umbrella on the user's person and to free his hands. For instance, U.S. Pat. No. 1,827,524 discloses a holder which may be used to carry a closed umbrella and which relies on alligator clips to attach two separate members, an upper member and a lower member, to the front of the user's shirt or jacket. The disadvantages associated with this approach are several fold. Firstly, the approach utilizes two separate members which can easily be separated and lost. Secondly, the closed umbrella, if it is wet, will drip and wet the user's clothing. Thirdly, the upper and lower members have a number of moving parts which will eventually wear out and break.

U.S. Pat. No. 2,926,826 discloses a complicated arrangement which basically comprises a harness fitting over both shoulders of the user and having cross members in front and in back. Straps are provided in the back to tie an umbrella crosswise to the depending leg members. This device is cumbersome and does nothing to protect the wearer's clothing from a wet umbrella.

U.S. Pat. No. 4,261,494 discloses a carrier for an umbrella which wraps around the umbrella so as to enable a person to suspend the umbrella from his shoulder. This is, however, a relatively inconvenient arrangement which requires considerable attention and manipulation on the part of the person using the holder.

In view of these considerations there is a need for a new and improved umbrella holder, specifically for use with an umbrella having a telescoping stem.

SUMMARY OF THE INVENTION

It is a feature of the instant invention to provide a holder for a closed umbrella which is convenient and which protects the user from water which may have accumulated on an umbrella and remains on the umbrella even after the umbrella is folded.

In view of this feature and other features, the instant invention contemplates a holder for carrying a closed umbrella of the type having a telescoping stem wherein the holder includes in combination: a sheath for receiving and retaining the closed umbrella; a stiffening material for stiffening the sheath so that the sheath retains its shape whether or not the umbrella is inserted; a carrying strap for suspending the sheath from one's shoulder or across the body, and a means for securing the umbrella within the sheath to prevent the umbrella from becoming dislodged therefrom.

DESCRIPTION OF THE PREFERRED EMBODIMENT

Figure 1:
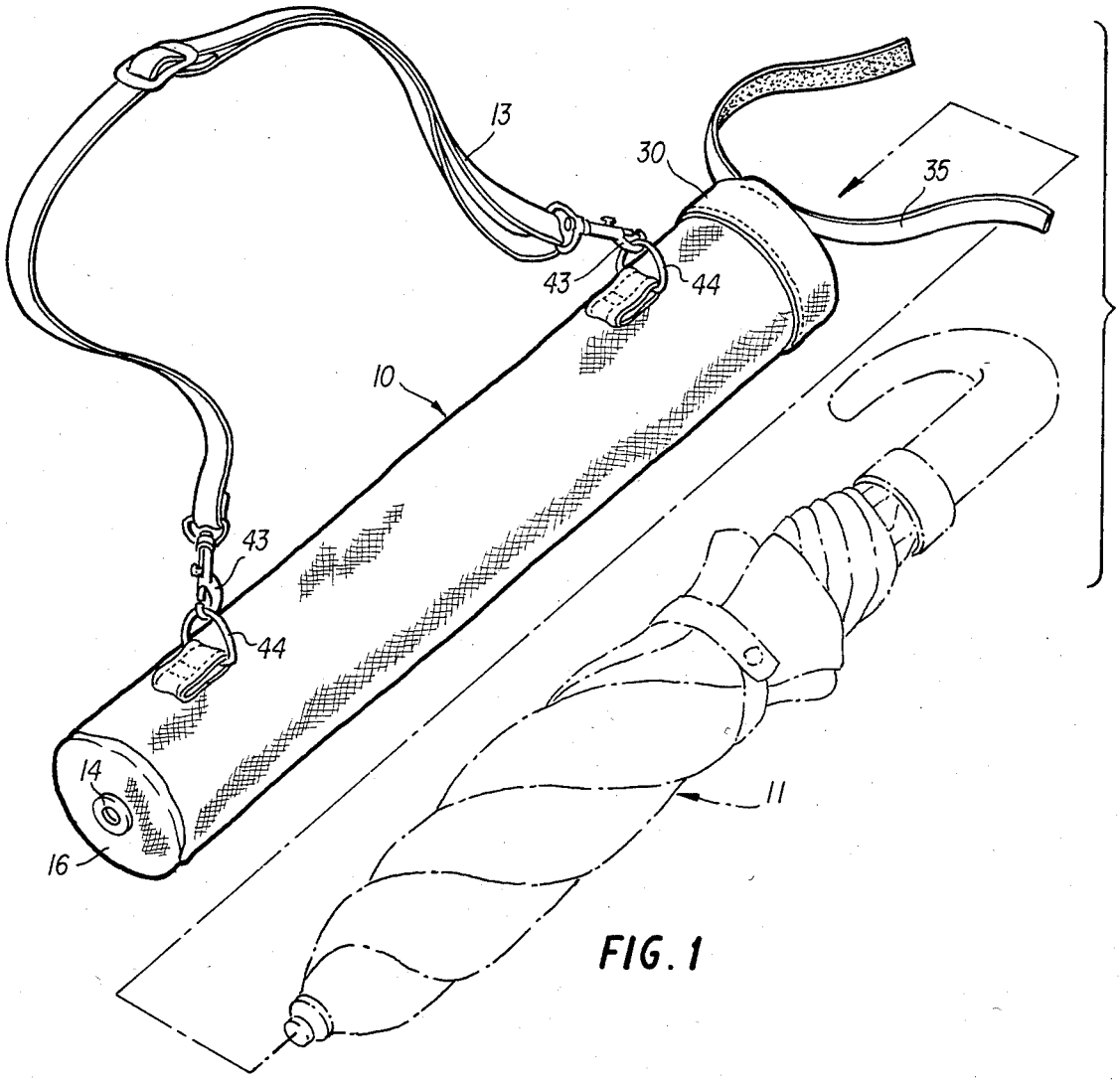
FIG. 1 is a perspective view showing an umbrella holder in accordance with the instant inventor and an umbrella with a telescoping stem which is carried in the holder.

Referring now to FIG. 1, FIG. 1 discloses an umbrella holder, designated generally by the Numeral 10, for holding an umbrella, designated generally by the Numeral 11. The umbrella holder 10 has attached thereto an adjustable strap 13 which permits one to suspend the holder from one's shoulder or across the body. Preferably, the umbrella holder 10 has been stiffened so as to retain its shape even when the umbrella 11 is not inserted into the holder. Since the umbrella 11 may be inserted into the holder 10 while the umbrella is still wet, a drain hole, preferably defined by a brass grommet 14 is positioned within the bottom 16 of the holder. Preferably, the holder 10 is made of a waterproof material such as vinyl which comes in a wide variety of colors and fabric designs. The holder 10 is approximately fourteen inches long and has an inner diameter of approximately two and one half inches.

Figure 2:
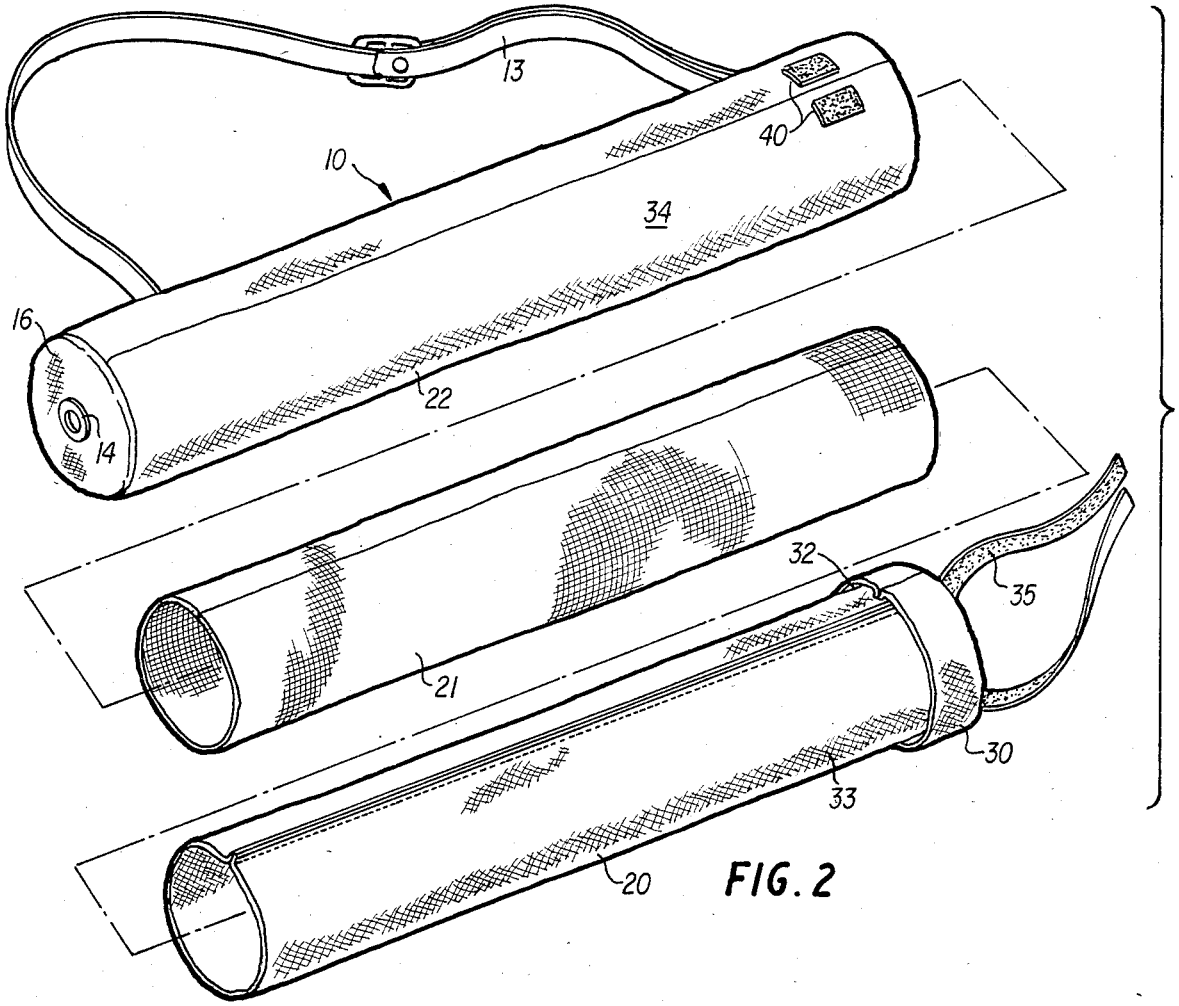
FIG. 2 is an exploded perspective view of the umbrella holder.
Figure 3:
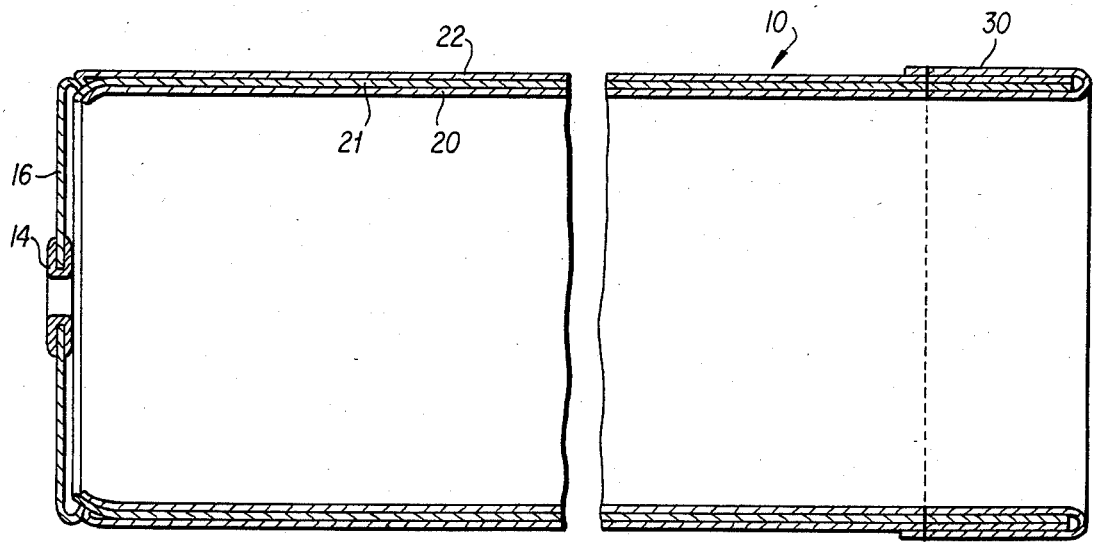
FIG. 3 is a cross section of the umbrella holder.

Referring now to FIGS. 2 and 3, in accordance with the preferred embodiment of the invention, the holder 10 includes an inner sleeve 20, a stiffening layer 21 and an outer sleeve 22. The inner sleeve 20, is preferably made of a vinyl-like material which defines a smooth inner surface so that an umbrella 11 will slide easily in and out of the holder 10. The stiffening layer 21 may be made of a fabric such as BRCRUM which is flexible enough to be easily configured into a tube and which may be bent. Alternatively, a plastic stiffening material having the characteristics of BRCRUM may be used. The stiffening material 21 is relatively easily deformed but once the deforming force is released, the stiffening layer 21 tends to return to its original, cylindrical configuration. The outer sheath 22 is made of flexible vinyl and is configured into a tube by stitching the free ends of a rectangular piece together at seam 28. The bottom 16 is stitched to the outer sleeve 22.

In accordance with one embodiment of the invention, the inner sleeve 20 has a cuff 30 which is folded over to define a space 32 between the outer surface 33 of the inner sleeve 20 and an inner surface of the cuff. When the holder 10 is assembled, the cuff 30 overlies both the stiffener 21 and the outer sleeve 22. The inner surface of the cuff which abuts the outer surface 34 of the sleeve 22 is preferably adhered thereto by an adhesive or may be stitched thereto. In accordance with another embodiment of the invention the cuff 30 is not used and the inner sleeve 20, outer sleeve 22 and stiffener 21 are simply adhered together at the open end of the holder. In any event, the resulting assembly is waterproof.

Figure 4:
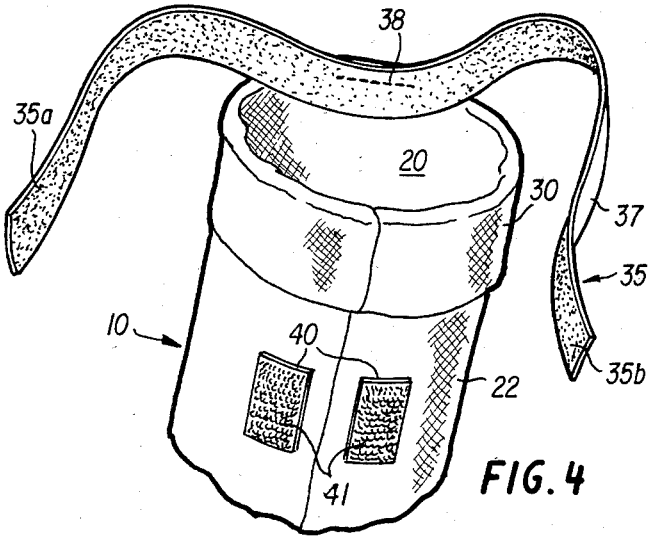
FIG. 4 is a perspective view showing the top of the casing with the strap casing and a strap for securing the umbrella in the casing.
Figure 5:
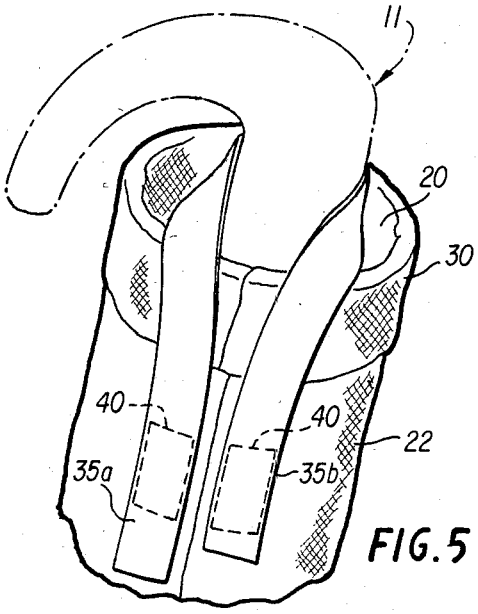
FIG. 5 is a perspective view showing the top of the casing with the strap of FIG. 3 holding the umbrella in place.

As is seen in FIGS. 4 and 5, in order to secure the umbrella 11 within the holder 10, a strap 35 is provided which has a first surface with VELCRO loops 36 or other fasteners and a second surface 47 which is smooth and preferably has the same appearance as the outer surface of outer sleeve 22. The strap 35 is secured midway between its ends by stitching 38 to the inner surface of the inner sleeve 20. A pair of VELCRO fasteners 40 with hooks 41 thereon are stitched to the outer sleeve 22 for engagement by the loops 36 of the straps 35. Two lengths 35*a* and 35*b* of the strap 35 are fastened over the opening of the holder 10 and secured to the fastener 40 to hold the umbrella within the holder 10. Other types of fasteners also suitable. While a pair of straps 35*a* and 35*b* are shown, and are preferred, a single strap could also be utilized with a suitable fastener. In addition, the strap might also be attached to the outside of the holder 10 rather than to the inner surface of the holder 10.

As is seen in FIG. 1, the carrying strap 13 has hooks 43 at each end or at one end thereof which are secured to loops 44 attached to the outer sleeve 22. Preferably the length of the strap 13 is adjustable.

The foregoing example of the preferred embodiment is merely illustrative of the invention which is to be limited only by the following claims.

I claim:

1. A separate holder for carrying a closed umbrella of the type having a telescoping stem and a handle, the holder in combination with the umbrella comprising:

a non-metallic sheath having first and second ends wherein the first end is always open and wherein the handle of the umbrella protrudes beyond the first end when the umbrella is inserted into the non-metallic sheath, the sheath having a substantially cylindrical shape and a diameter approximating that of a closed umbrella, the sheath including non-metallic stiffening means and a smooth inner surface, wherein the closed umbrella slides easily in and out of the first end of the sheath;

a carrying strap secured to the sheath at spaced locations thereon for carrying the holder suspended from a user's shoulder, and means for securing the umbrella in the sheath without closing the first end thereof.

2. The holder of claim 1 wherein the sheath is approximately fourteen inches long and two and one half inches in diameter.

3. The holder of claim 1 wherein the sheath further includes a bottom proximate the second end thereof.

4. The holder of claim 3 wherein the bottom has a hole therein for drainage of moisture.

5. The holder of claim 1 wherein the means for securing the umbrella within the sheath includes a flexible strap having one portion thereof fixed to the sheath adjacent the first end thereof and means for releasably securing another portion of the strap to the sheath wherein the strap overlies the first end of the sheath preventing the umbrella from being dislodged therefrom.

6. The holder of claim 5 wherein the strap is attached midway between the ends thereof and wherein means for the releasably securing another portion of the strap includes a fastener attached to the sheath which cooperates with a fastener on the strap.

7. The holder of claim 6 wherein the fasteners are cooperating strips of VELCRO material.

* * * * *